US005092144A

United States Patent [19]

Fleming et al.

[11] Patent Number: 5,092,144

[45] Date of Patent: Mar. 3, 1992

[54] DOOR HANDLE AND LOCK ASSEMBLY FOR SLIDING DOORS

[75] Inventors: Paul D. Fleming, Glendale; Nandor Gajer, Woodland Hills, both of Calif.

[73] Assignee: W&F Manufacturing, Inc., Glendale, Calif.

[21] Appl. No.: 544,835

[22] Filed: Jun. 27, 1990

[51] Int. Cl.[5] ..... E05B 65/08

[52] U.S. Cl. ..... 70/95; 70/100; 70/462; 292/244; 292/DIG. 46

[58] Field of Search ..... 70/95, 99, 100, 450–452, 70/462; 49/382; 292/244, 245, DIG. 46

[56] References Cited

U.S. PATENT DOCUMENTS

| | | | |
|---|---|---|---|
| 1,765,186 | 6/1930 | Vaicekauckas | 70/462 |
| 3,095,227 | 6/1963 | Casebolt | 70/100 X |
| 3,105,711 | 10/1963 | Woodworth et al. . | |
| 3,198,564 | 8/1965 | Welsh | 292/DIG. 46 X |
| 3,353,855 | 11/1967 | Smith | 70/95 X |
| 3,563,068 | 2/1971 | Dushane, Jr. | 70/100 |
| 4,243,256 | 1/1981 | Frydrych | 292/245 |
| 4,671,089 | 6/1987 | Fleming et al. . | |
| 4,754,624 | 7/1988 | Fleming et al. . | |
| 4,835,997 | 6/1989 | Akright | 292/244 X |
| 4,934,800 | 6/1990 | Choi | 292/244 X |
| 4,973,091 | 11/1990 | Paulson et al. | 292/DIG. 46 X |
| 4,982,986 | 1/1991 | Gresset, Jr. | 292/244 X |

FOREIGN PATENT DOCUMENTS

| | | | |
|---|---|---|---|
| 2164812 | 7/1973 | Fed. Rep. of Germany | 70/452 |
| 0117744 | 2/1984 | United Kingdom . | |

*Primary Examiner*—Gary L. Smith
*Assistant Examiner*—Suzanne L. Dino
*Attorney, Agent, or Firm*—Kelly Bauersfeld & Lowry

[57] ABSTRACT

An improved door handle and lock assembly is provided for use with sliding glass patio doors of the type used in residential dwellings and the like. The handle and lock assembly comprises inside and outside escutcheons for mounting onto the vertical stile at one side edge of a sliding door and carrying a respective pair of handles for use in manually sliding the door between open and closed positions. A lock mechanism mounted into the stile is operated by a keyed lock cylinder unit mounted on the outside escutcheon and by a manually pivoted latch lever mounted on the inside escutcheon. The handles and latch lever are adapted for reversible mounting onto their associated escutcheons to permit reconfiguration of the assembly for mounting onto the stile at the left or right side edge of the door. In addition, the outside escutcheon is supported on the door stile by an inside bracket plate which permits partial mounting of the assembly onto the door and to permit operation of the lock mechanism without the inside escutcheon during a construction phase, with the inside escutcheon being subsequently mounted over and concealing the bracket plate.

43 Claims, 8 Drawing Sheets

FIG. 8
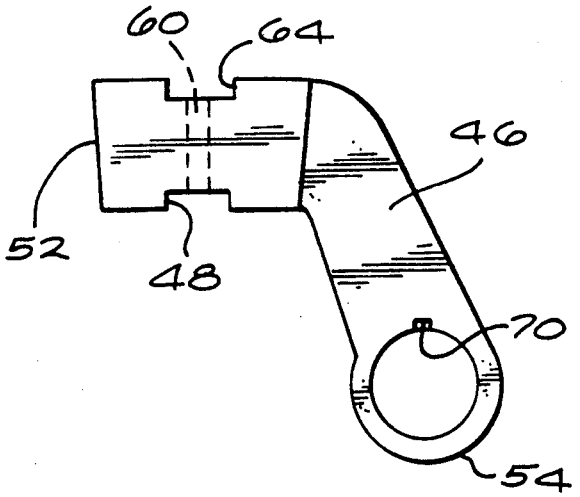
FIG. 9
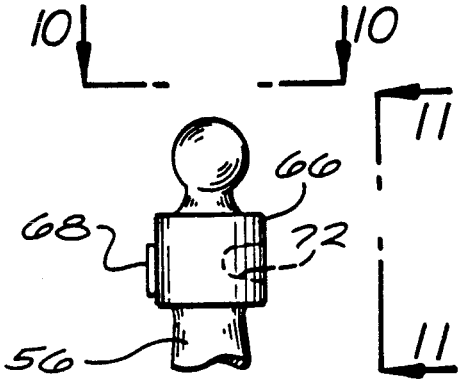
FIG. 10
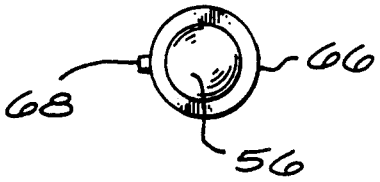
FIG. 11
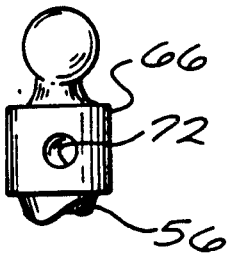
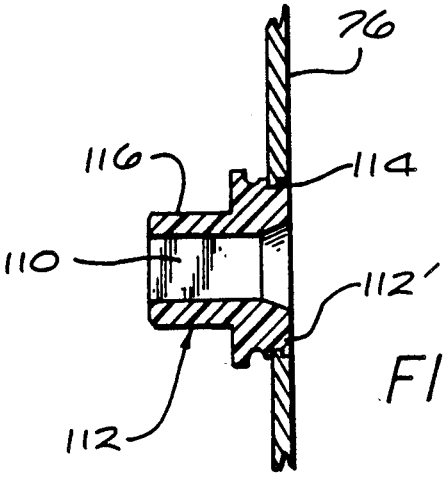
FIG. 12

FIG. 19
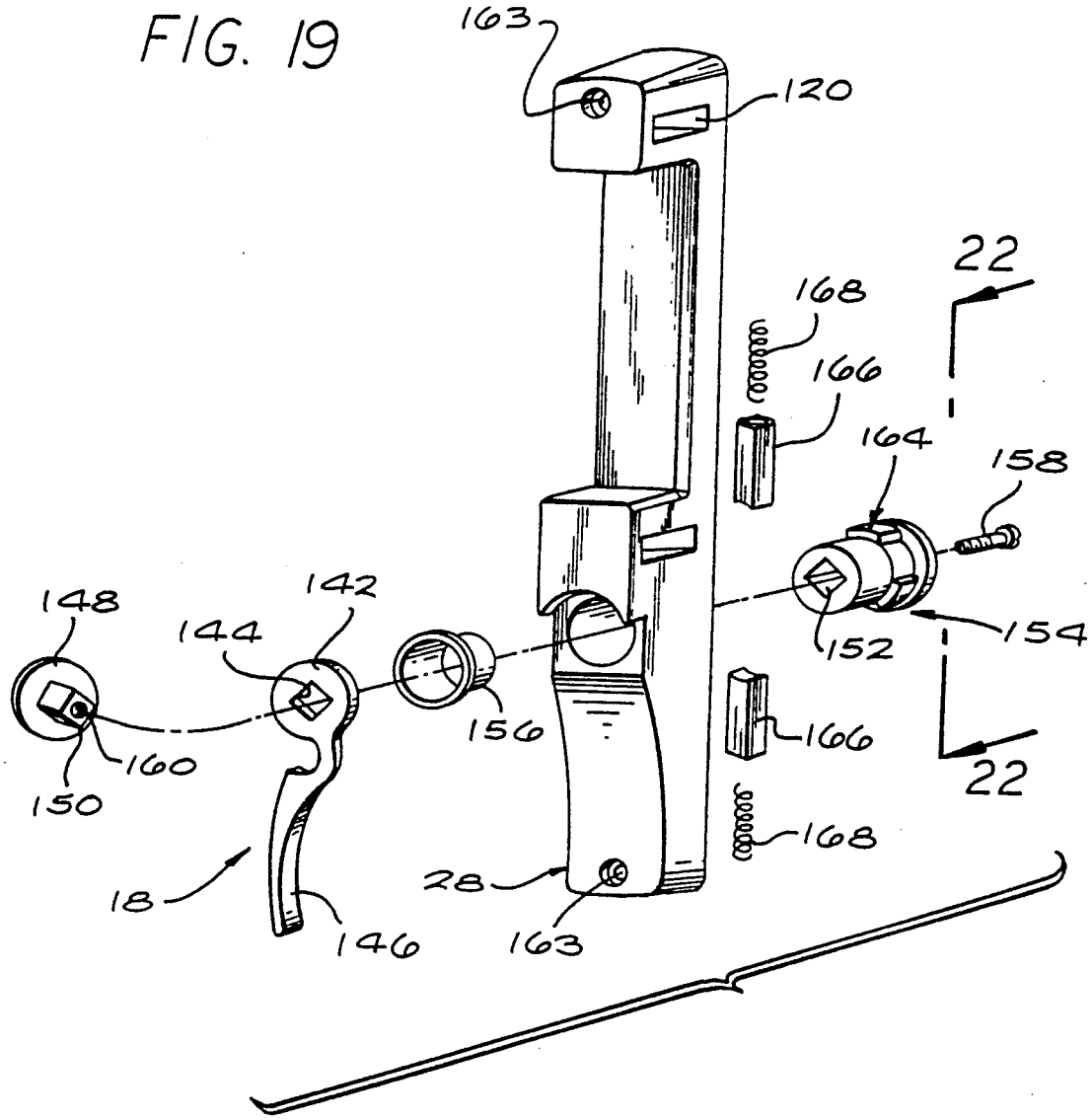
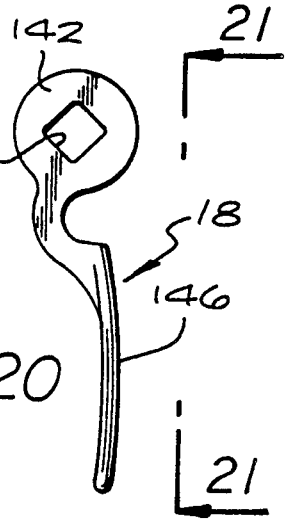
FIG. 20
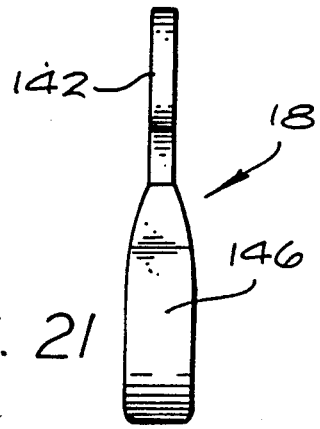
FIG. 21

DOOR HANDLE AND LOCK ASSEMBLY FOR SLIDING DOORS

BACKGROUND OF THE INVENTION

This invention relates generally to door handles and locking devices for use with sliding doors such as a sliding glass patio door or the like. More particularly, the invention relates to an improved handle and lock assembly adapted for reconfiguration to accommodate mounting onto a vertical door stile at the left or right side edge of a sliding door.

Sliding doors such as sliding glass patio doors and the like are well-known in the art and are commonly used in residential dwellings, apartment units, etc. Such sliding glass patio doors typically comprise one or more enlarged glass panes mounted within a surrounding metal or wooden frame adapted for sliding movement back-and-forth upon a lower track or rail. A vertical stile along one side edge of the sliding door normally carries a lock assembly adapted for keyless operation from the indoor side of the door, and, if desired, for keyed operation from the outdoor side of the door. The lock assembly normally includes a hook-shaped mortise latch for engaging a mating latch keeper mounted on the adjacent door jamb to lock the door against unauthorized movement to an open position.

More specifically, a typical lock assembly adapted for use with sliding doors includes inside and outside escutcheons which are interconnected by screws or the like passed through mounting holes formed in the associated door stile. In some designs, the escutcheons define recessed or ribbed handle surfaces for manual grasping to slide the door between open and closed positions. In other designs, the escutcheons support discrete handles adapted for relatively easy manual grasping to operate the sliding door. To avoid interference with adjacent structures such as screen doors, drapery coverings and the adjacent door jamb, such door handles are commonly offset to one side of the escutcheons in a direction away from the adjacent door jamb. The lock mechanism is mounted within the stile at a position between the escutcheons, in operative association with a movable latch lever or the like mounted on the inside escutcheon.

In the past, significant design effort has focused upon the provision of a reversible or reconfigurable lock assembly which can be mounted onto the stile at either the left or right side edge of a sliding door. Such design efforts have provided door handles adapted for reversible mounting onto the associated escutcheons to accommodate left or right stile mounting positions. See, for example, U.S. Pat. No. 4,754,624. However, these prior designs have required the use of door handles having relatively complex shapes which can be difficult and costly to produce especially when attractive metal plating finishes are desired. Moreover, the associated locking devices at the indoor side of the door have often been relatively small to accommodate reversible mounting, wherein such small locking structures can be difficult for some persons to operate and further do not provide a highly visible indicator or flag representing the locked or unlocked state of the door.

The improved door handle and lock assembly of the present invention provides relatively large and easily grasped door handles shaped for versatile and relatively easy reversible mounting onto associated inside and outside escutcheons, and further including a relatively large and easily operated inside latch lever adapted for reversible mounting onto the inside escutcheon. All of the exposed components of the improved lock assembly are shaped for relatively economical plating with a selected high quality surface finish.

SUMMARY OF THE INVENTION

In accordance with the invention, an improved door handle and lock assembly is provided for use with sliding doors, particularly such as sliding glass patio doors and the like. The handle and lock assembly comprises inside and outside escutcheons adapted for mounting onto the opposite sides of a door stile along the left or right side edge of a sliding door, with easily grasped handles being reversibly mounted onto these escutcheons. A lock mechanism mounted within the door stile is selectively operated from the indoor side of the door by a relatively large and reversibly mounted latch lever carried on the inside escutcheon. A keyed lock cylinder may also be mounted on the outside escutcheon for keyed operation of the lock mechanism.

In the preferred form of the invention, the inside and outside escutcheons include laterally open slots for reversibly receiving a pair of laterally extending support arms of the associated door handle. The support arms are secured to the associated escutcheon by screws or the like fastened into the blind side of the escutcheon, to position the support arms to project outwardly from one side of the escutcheon. A handle grip bar is carried between the outboard ends of the support arms. The grip bar and associated support arms comprise separate components adapted for facilitated and economical plating with a high quality surface finish and include interlocking key means for rigid interlocked assembly when the support arms are attached to the associated escutcheons.

The outside escutcheon is mounted onto the door stile by a plurality of mounting screws extending through a bracket plate at the indoor side of the stile and associated preformed mounting holes formed in the stile. To facilitate plating of the outside escutcheon, the mounting screws are fastened into threaded mounting sleeves at the blind side of the outside escutcheon, wherein these sleeves have a vented or open part-cylindrical shape to facilitate drainage of plating solutions therefrom. Fillet webs are formed about these threaded sleeves, particularly at the open margins thereof, to provide structural reinforcement which prevents forced deformation of the sleeve shape.

The inside bracket plate carries a rotatable drive adapter in operative association with the lock mechanism mounted in the side edge of the door stile, such as a mortise lock cartridge, or the like. In the preferred form, the drive adapter has a slotted construction to receive the blade-shaped tailpiece of a keyed lock cylinder unit mounted on the outside escutcheon, wherein the tailpiece extends into operative association with the lock mechanism. The drive adapter defines exposed drive surfaces such as a square head shaped for relatively easy rotatable engagement with a mating tool, such as a specialized contractor's key. With this construction, the bracket plate and outside escutcheon can be mounted onto the door in a manner permitting operation of the lock mechanism by means of the keyed lock cylinder unit and the drive adapter, for example, during a construction phase, without requiring installation of the inside escutcheon.

The inside escutcheon is mounted in turn onto the door stile in a manner overlying and concealing the bracket plate, by means of suitable mounting screws or the like. The inside escutcheon supports the associated reversibly mounted handle, as previously described, and further supports the latch lever in a selected reversible mounting position in operative association with a drive head. When the inside escutcheon is mounted onto the bracket plate, the drive head engages the drive adapter to permit operation of the lock mechanism upon pivoting movement of the latch lever. The reversible mounting capability of the latch lever permits said lever to have a relatively large size and shape for easy manipulation and to provide a readily visible flag indicative of a locked or unlocked state.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 8 is an enlarged plan view of a support arm for the outdoor handle, taken generally on the line 8—8 of FIG. 5;

FIG. 9 is an enlarged fragmented elevational view of a portion of an outdoor handle grip bar;

FIG. 10 is a top plan view of the grip bar taken generally on the line 10—10 of FIG. 9;

FIG. 11 is a fragmented side elevational view of the grip bar taken generally on the line 11—11 of FIG. 9;

FIG. 12 is an enlarged fragmented vertical sectional view taken generally on the line 12—12 of FIG. 3;

FIG. 19 is an exploded perspective view illustrating assembly of a pivoting latch lever with the inside escutcheon;

FIG. 20 is an elevational view of the latch lever in a reversed position;

FIG. 21 is a side elevational view of the latch lever taken generally on the line 21—21 of FIG. 20;

DETAILED DESCRIPTION OF THE PREFERRED EMBODIMENT

Figure 1:
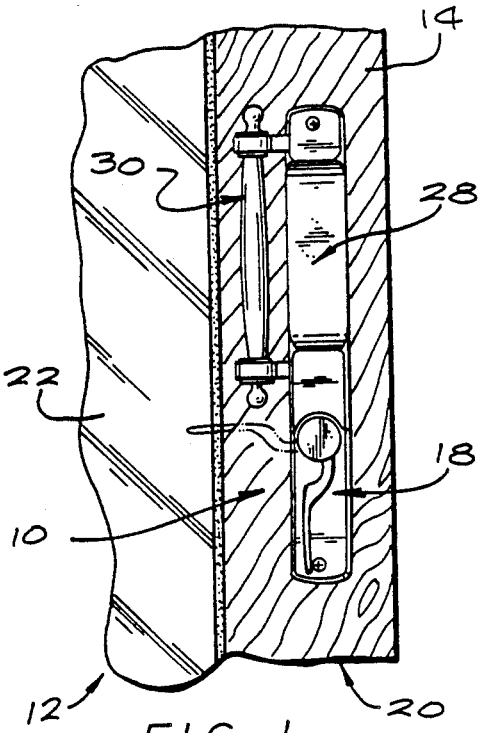
FIG. 1 is a fragmented indoor side elevational view depicting an improved door handle and lock assembly embodying the novel features of the invention and showing the assembly installed onto a vertical door stile at one side edge of a sliding door.
Figure 2:
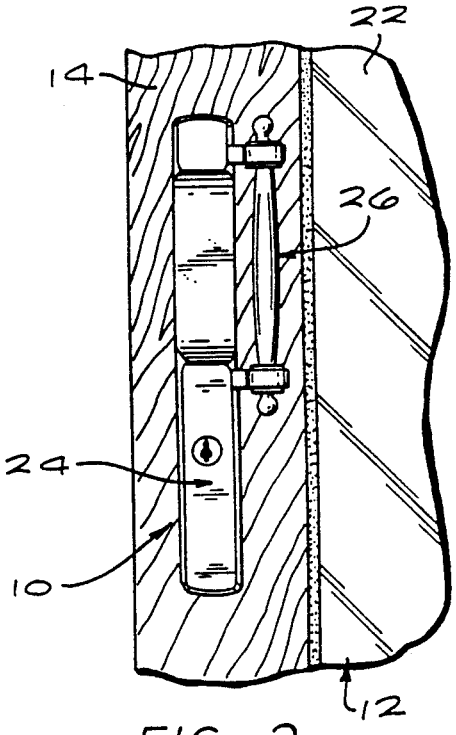
FIG. 2 is a fragmented outdoor side elevational view of the door handle and lock assembly of FIG. 1.
Figure 25:
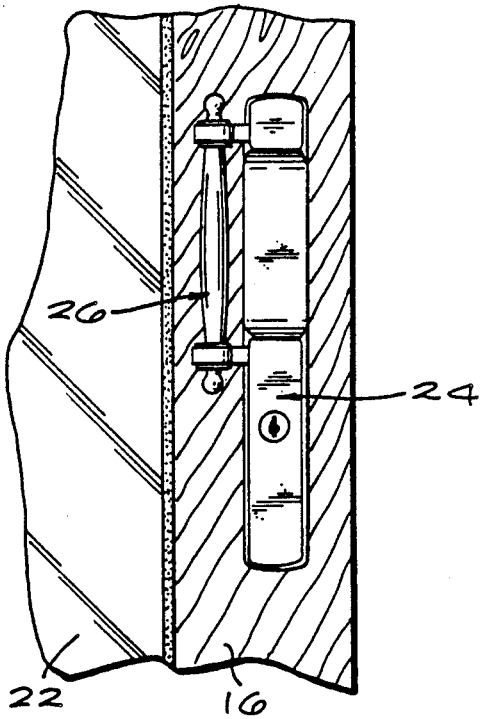
FIG. 25 is a fragmented outdoor side elevational view similar to FIG. 2, but depicting installation at the opposite stile of the sliding door.
Figure 24:
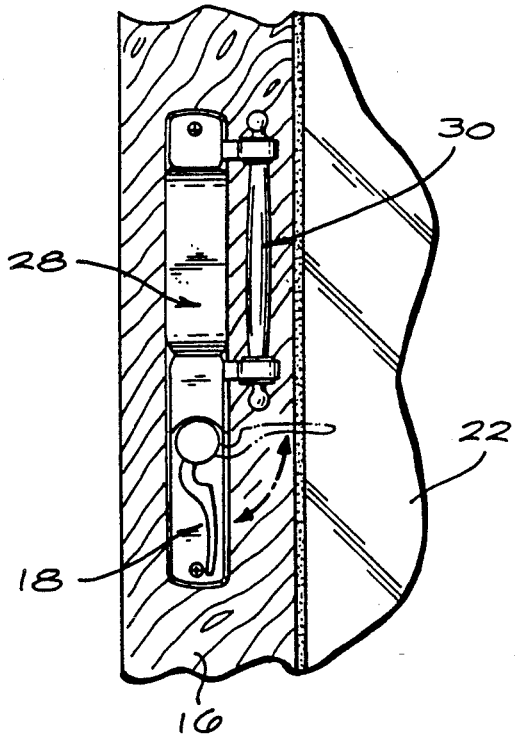
FIG. 24 is a fragmented indoor side elevational view of the improved door handle and lock assembly similar to FIG. 1, but depicting installation at the, opposite vertical stile of a sliding door.

As shown in the exemplary drawings, an improved door handle and lock assembly referred to generally in FIGS. 1 and 2 by the reference numeral 10 is provided for use with a sliding door 12, such as a sliding glass patio door or the like. The handle and lock assembly 10 is adapted for relatively quick and easy reconfiguration to accommodate selective mounting onto a vertical stile at either, the left or right side edge of the sliding door 12. For example, FIGS. 1 and 2 illustrate the invention mounted onto a vertical stile 14 at one side edge of the door, whereas FIGS. 24 and 25 depict the invention in an alternative configuration for mounting onto a stile 16 at the opposite side edge of the door 12. In either configuration, the invention includes a relatively large and easily manipulated latch lever 18 at the indoor side of the door to selectively lock and unlock the door with respect to an adjacent jamb (not shown), with the large size of the latch lever 18 providing a easily visible flag representative of the locked or unlocked state.

The improved door handle and lock assembly of the present invention is designed particularly for use with sliding glass patio doors of the type commonly used in residential dwellings, apartment units, etc. Such sliding doors typically include a generally rectangular door frame 20 normally encasing one or more enlarged glass panes 22, with FIGS. 1 and 2 illustrating a portion of the frame 20 defining the generally vertically extending stile 14 at one side edge of the door. The invention is mounted onto this vertical stile for selective locking association with a conventional latch keeper (not shown) mounted on the adjacent door jamb (also not shown) when the door is in the closed position. Importantly, the invention is designed for relatively quick and easy reconfiguration for mounting onto the door 12 in a reversible manner and to accommodate a variety of standard and custom mounting hole patterns formed in the door stile. Moreover, the individual components of the assembly 10 are shaped for relatively economical plating processing to apply a high quality finish to exposed surfaces, and further to provide rigid structural integrity when the components are assembled onto the door.

Figures 3, 4:
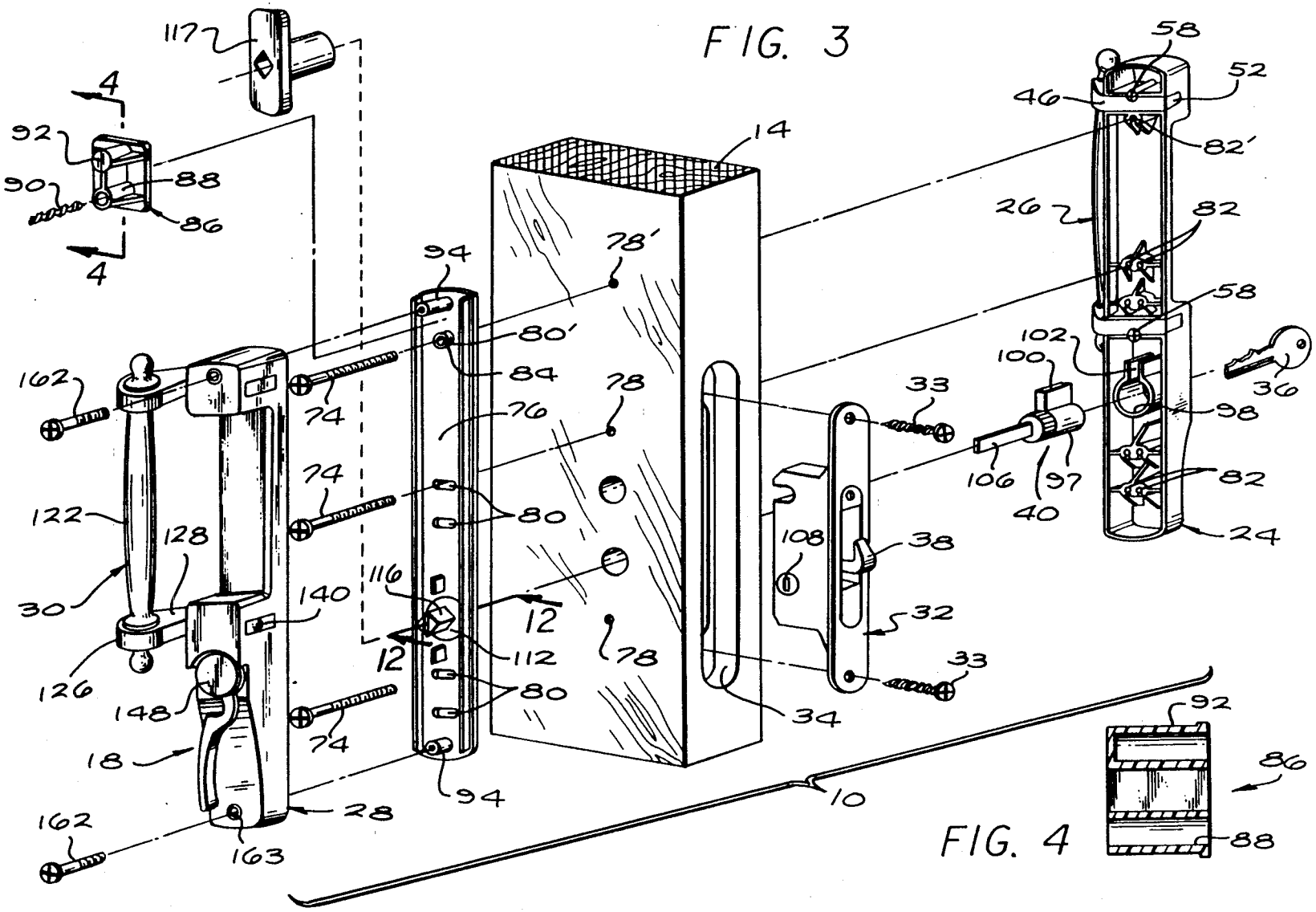
FIG. 3 is an enlarged and exploded perspective view illustrating the door handle and lock assembly of FIGS. 1 and 2.
FIG. 4 is an enlarged vertical sectional view taken generally on the line 4—4 of FIG. 3.

As shown generally, in FIGS. 1–3, the improved door handle and lock assembly 10 includes an outside escutcheon 24 having a handle 26 mounted securely thereon. The outside escutcheon 24 is interconnected through the door stile 14 to an inside escutcheon 28 which also has a handle 30 mounted securely thereto. The outside and inside escutcheons 24 and 28 respectively support means for operating a lock mechanism 32 (FIG. 3), such as a mortise-type cartridge mounted by means of mounting screws 33 or the like within an appropriate edge pocket 34 formed in the stile 14. The illustrative lock mechanism 32, which may conform to the mechanism shown and described in U.S. Pat. No. 3,105,711, which is incorporated by reference herein, includes a hook-shaped latch 38 for releasably engaging and locking with a conventional mating keeper (not shown) on an adjacent door jamb (also not shown) when the door is closed. A conventional keyed lock cylinder unit 40 is mounted on the outside escutcheon 24, and the relatively large latch lever 18 is mounted on the inside escutcheon 28 in operative association with the lock mechanism 32. Accordingly, the door handle and lock assembly 10 is adapted to be locked or unlocked from the outdoor side of the door 12 by means of a key 36 (FIG. 3), and from the indoor side of the door by means of pivoted rotation of the latch lever 18 between the solid and dotted line positions depicted in FIG. 1.

As shown in FIGS. 3 and 5–11, the outside escutcheon 24 is adapted for reversible and secure connection with the outdoor handle 26. More particularly, the outside escutcheon 24 includes an exposed outer surface 42 of a selected decorative shape which is desirably plated with a selected and high quality surface finish such as polished brass, burnished brass, etc. The escutcheon 24 is shaped to define a pair of laterally open and vertically spaced slots 44 for removable reception and seating mounting of a corresponding pair of support arms 46 forming a portion of the outdoor handle 26. Each support arm 46 has a base end with a forward notch 48 (FIG. 8) formed therein to interlock with a rib 50 (FIGS. 6 and 7) on the blind side of the outside escutcheon 24 to project part-way into the associated handle slot 44. When the two support arms 46 are seated within these slots 44, a side face 52 (FIG. 5) of each support arm is disposed substantially flush (FIG. 3) with one side face of the escutcheon 24. In this position, a contoured arm portion of each support arm 46 projects outwardly from the opposite side face of the outside escutcheon 24 and terminates at a distal end defining a cylindrical support ring 54 for receiving and supporting a grip bar 56 of the outdoor handle 26.

Figure 5:
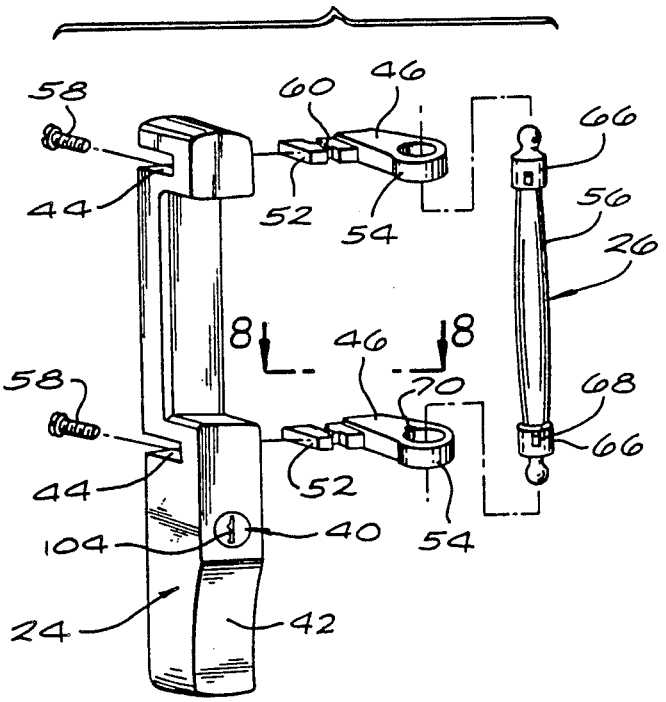
FIG. 5 is an exploded perspective view of an outside escutcheon and related door handle.

Each support arm 46 is securely attached to the outside escutcheon 24 by means of a mounting screw 58 (FIGS. 3 and 5). In this regard, the base end of each support arm 46 has a semicylindrical recess 60 which aligns with a similar semicylindrical recess 62 formed at the blind side of the escutcheon 24, with each aligned pair of the recesses 60 and 62 cooperatively defining a bore for receiving one of the mounting screws 58. In the preferred form, each mounting screw 58 comprises a self-threading screw and has a relatively shallow head adapted for countersink fit into a shallow notch 64 (FIG. 8) formed in the support arm end.

Prior to connection of the support arms 46 to the outside escutcheon 24, the grip bar 56 is seated within the open support rings 54 of the two support arms 46. In particular, as shown in FIGS. 5 and 8–11, the grip bar 56 is formed in a selected decorative shape to include a pair of generally cylindrical cuffs 66 near the opposite ends thereof. These cuffs 66 are sized and shaped for relatively close fit reception into the support rings 54 of the two support arms 46. Importantly, the cuffs 66 include outwardly protruding keys 68 to lock into key slots 70 within the support rings 54 to provide a secure component interconnection without grip bar rotation or vertical displacement. Moreover, in accordance with one aspect of the invention, the grip bar cuffs 66 may include shallow recessed dimples 72 used for mounting each grip bar 56 onto a plating rack (not shown) during surface plating processes, wherein the dimples 72 are concealed from view within the cuffs 66 after component assembly. The handle subassembly, including the support arms 46 and associated grip bar 56, is quickly and easily secured to the outside escutcheon 24 by the mounting screws 58 to provide a sturdy and rigid handle construction.

In accordance with further features of the invention, the above-described mounting arrangement of the outdoor handle 26 onto the outside escutcheon 24 is reversible in accordance with the position of the handle and lock assembly 10 on the sliding door. That is, the handle 26 is normally positioned along the side of the escutcheon 24 opposite the adjacent door jamb to avoid interference with normal door opening and closing movements. When the invention is mounted onto the stile 14 at one side edge of the door 12, as shown in FIGS. 1 and 2, the outside handle 26 is installed along the right side of the escutcheon 24 as viewed in FIGS. 3 and 5. However, for installation onto the opposite door stile 16 as viewed in FIGS. 24 and 25, the positions of the support arms 46 of the outdoor handle 26 will be reversed relative to the outside escutcheon 24.

With reference to FIG. 3, the outside escutcheon 24 is securely mounted onto the stile 14 by a plurality of elongated mounting screws 74. These mounting screws 74 are passed through selected ones of a plurality of openings formed in a bracket plate 76 at the inside surface of the stile 14, and further through an aligned pattern of holes 78 in the stile. FIG. 3 illustrates the bracket plate 76 to include mounting holes 80 of laterally elongated shape and in a number and relative positions to accommodate a variety of standardized and custom hole patterns in the door stile 14. The elongated bracket plate hole 80 are aligned with threaded sleeves 82 at the blind side of the outside escutcheon 24, wherein these sleeves 82 are conveniently provided in laterally spaced pairs to accommodate the laterally elongated holes 80 in the bracket plate 76 in accordance with different standard hole patterns and positions in the stile.

FIG. 3 further illustrates an additional bracket plate hole 80' formed in a cylindrical post 84 near the upper end of the inside bracket plate 76. This additional hole 80' may not be provided as a part of a standardized hole pattern in the door stile 14, such that an aligned stile port 78' may need to be formed as by drilling. To facilitate this task, a plastic drill guide 86 (FIGS. 3 and 4) includes a guide sleeve 88 adapted to fit over the apertured post 84 on the bracket plate 76 and to receive the tip of a drill bit 90 used to form the port 78' in the door stile. An alignment cap 92 is also provided to fit over an adjacent bracket plate structure, such as a threaded sleeve 94 (to be described in more detail), to insure accurate alignment of the drill bit 90 and accurate formation of the stile port 78'. Accordingly, the inside bracket plate 76 can be securely attached to the outside escutcheon 24 by means of two mounting screws 74 passed through the elongated holes 80 in the bracket plate and fastened into one of the aligned sleeves 82 in the outside escutcheon. Thereafter, the drill guide 86 can be used in forming the stile port 78' for aligned passage of another mounting screw 74 for threaded connection into an upper threaded sleeve 82' at the blind side of the outside escutcheon 24.

Figure 6:
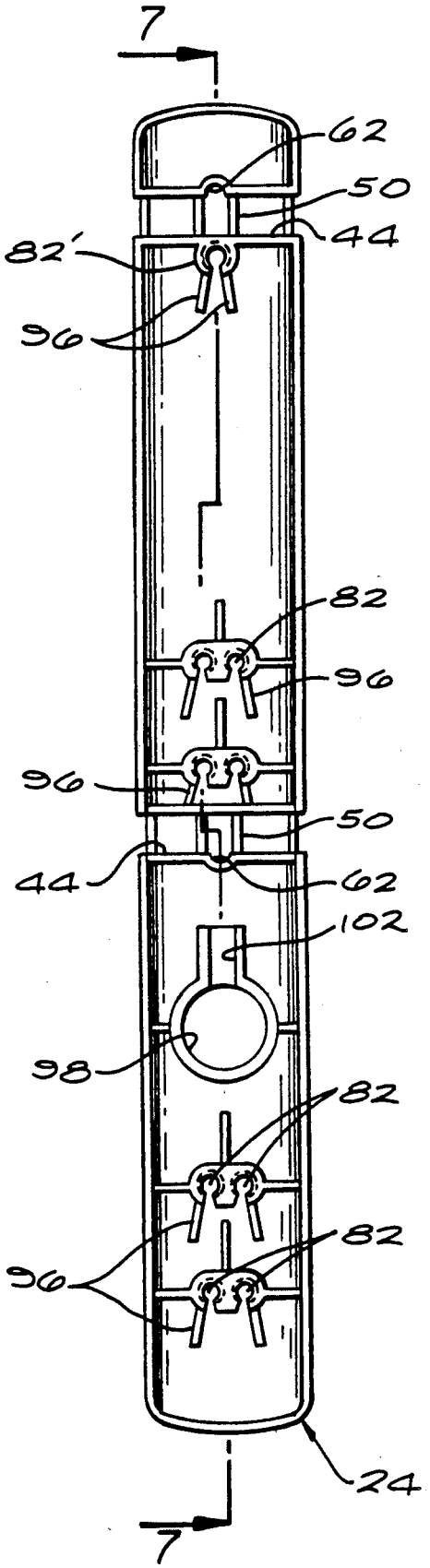
FIG. 6 is an enlarged blind side elevational view of the outside escutcheon.
Figure 7:
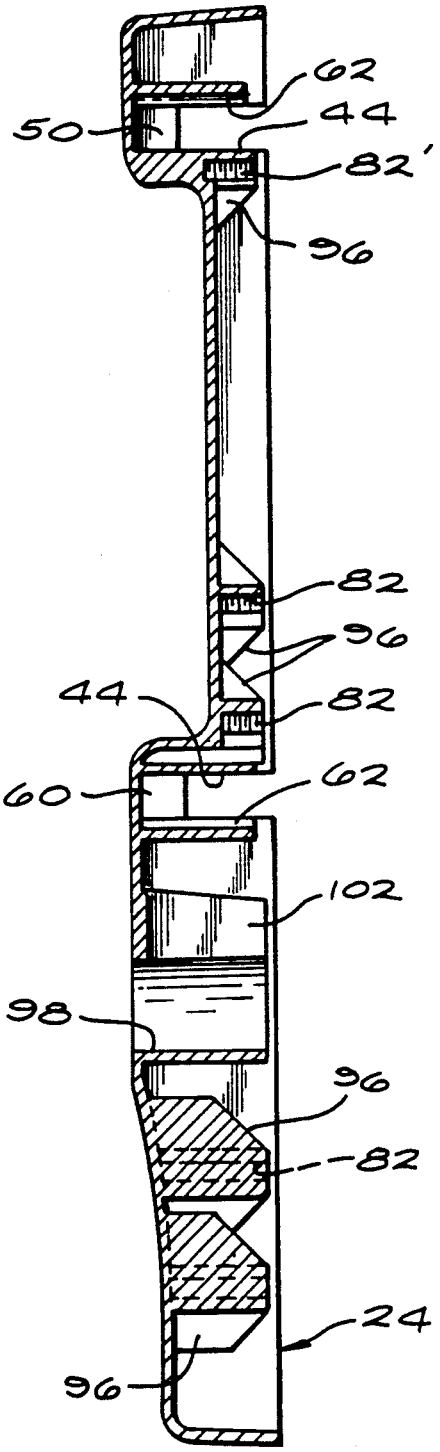
FIG. 7 is a vertical sectional view taken generally on the line 7—7 of FIG. 6.
Figure 13:
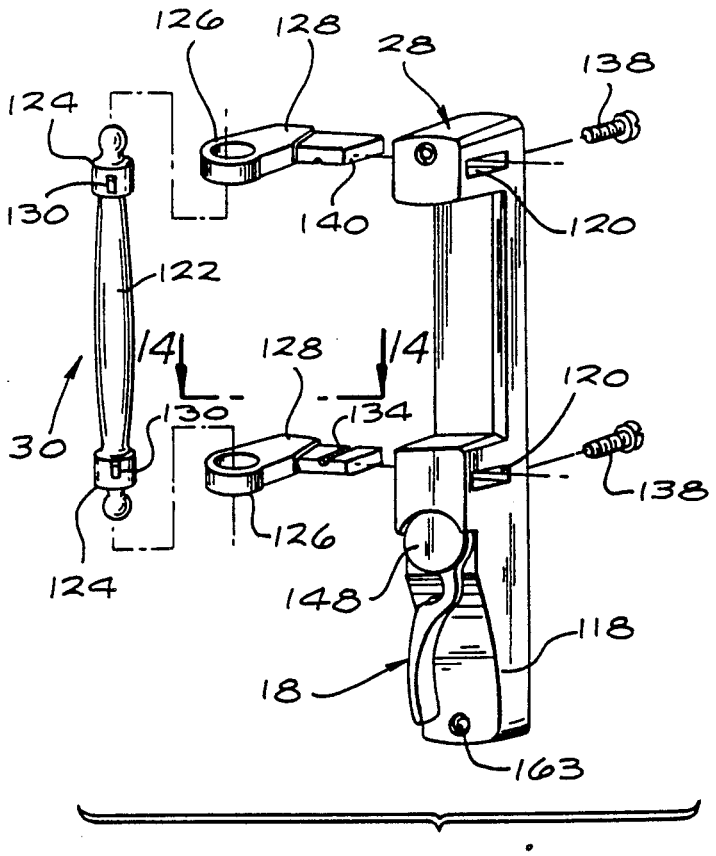
FIG. 13 is an enlarged exploded perspective view illustrating an inside escutcheon and related door handle.
Figure 14:
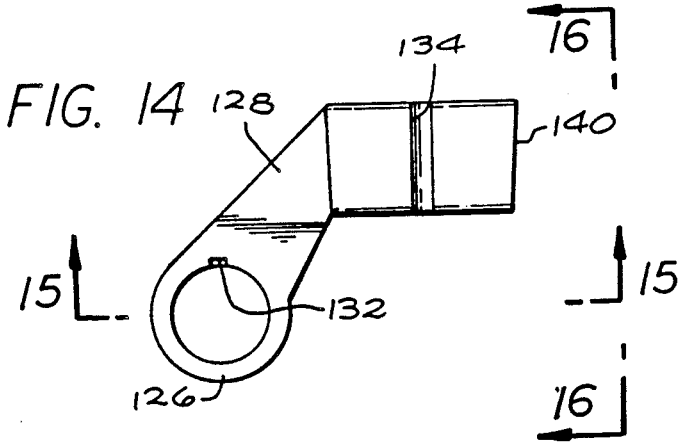
FIG. 14 is a plan view of a support arm for the inside handle taken generally on the line 14—14 of FIG. 13.
Figure 15:
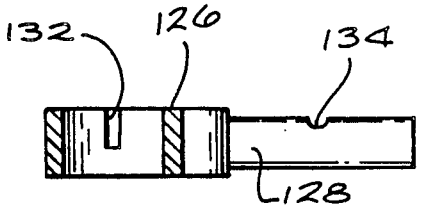
FIG. 15 is a vertical sectional view taken generally on the line 15—15 of FIG. 14.
Figure 16:
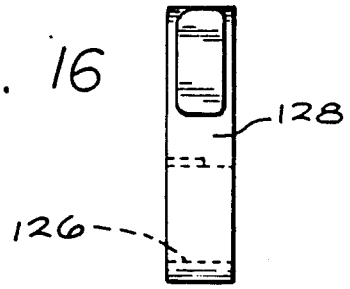
FIG. 16 is an end elevational view taken generally on the line 16—16 of FIG. 14.
Figure 17:
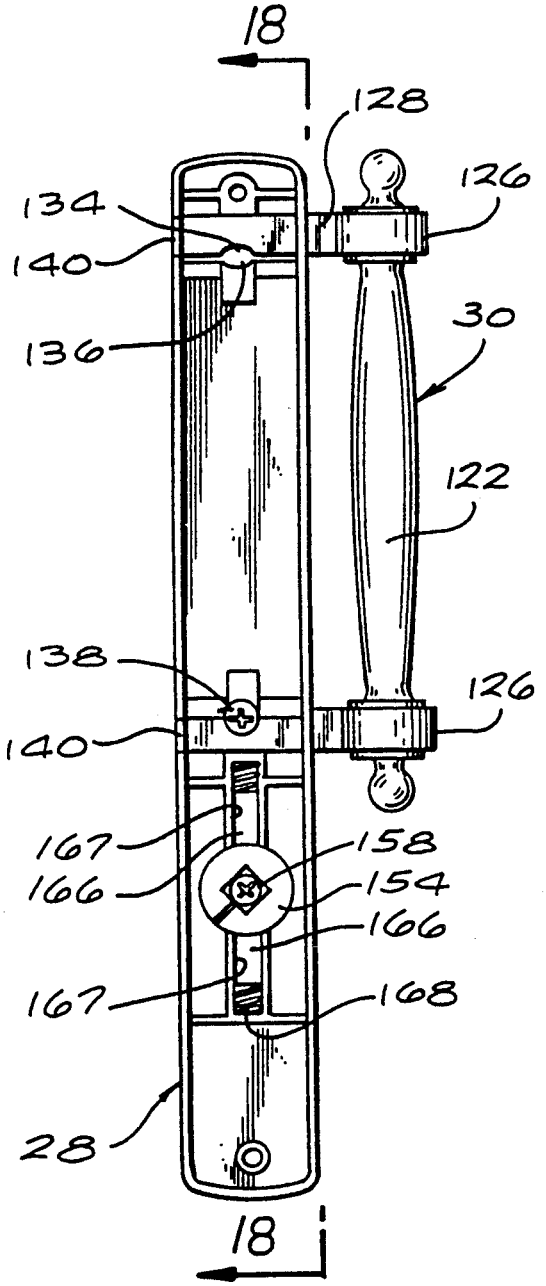
FIG. 17 is a blind side elevational view of the inside escutcheon.
Figure 18:
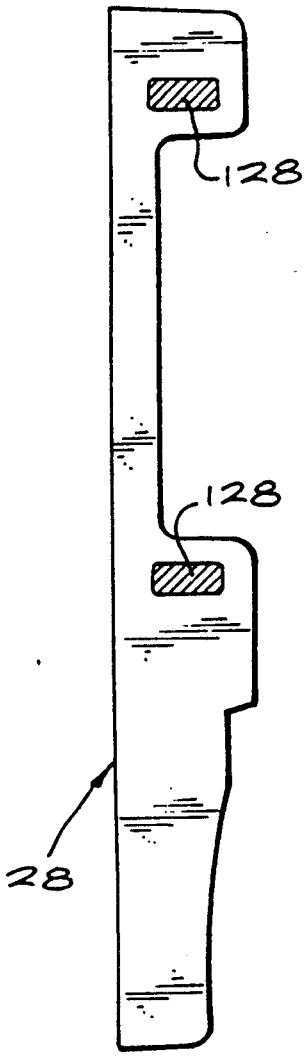
FIG. 18 is a vertical sectional view taken generally on the line 18—18 of FIG. 17.
Figure 22:
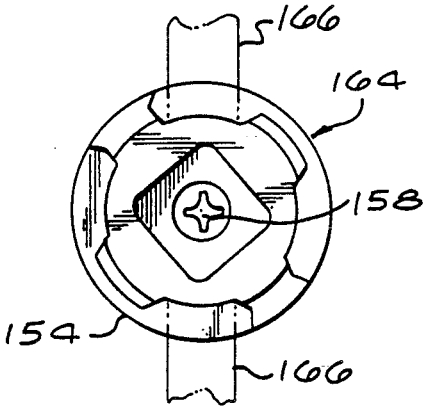
FIG. 22 is a fragmented vertical sectional view illustrating construction details of a drive head mounted on the inside escutcheon.
Figure 23:
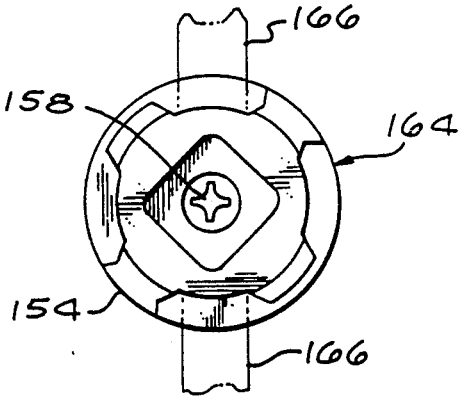
FIG. 23 is a fragmented elevational view similar to FIG. 22, but depicting the drive head in an alternative position.

As shown best in FIGS. 3, 6 and 7, the threaded mounting sleeves 82 and 82' at the blind side of the outside escutcheon 24 are laterally open or vented to provide part-cylindrical threaded bores for receiving the mounting screws 74. With this construction, the small bores defined by these threaded sleeves do not provide structures for capturing or trapping fluids during plating processes. That is, plating fluids which could otherwise plug the threaded bores and/or constitute hazardous contaminants are allowed to drain freely and thoroughly from the threaded sleeves during plating processes. Importantly, to prevent the vented sleeves 82 and 82' from opening due to stress deformation under load, each sleeve is associated with at least one and preferably multiple fillet webs 96 which significantly enhance the structural strength and structural integrity thereof. As shown in FIG. 3 in the preferred form, at least one fillet web 96 is provided along the open margin of each mounting sleeve.

The keyed lock cylinder unit 40 comprises a cylindrical case 97 having a size and shape for slide fit reception into a cylindrical receptacle 98 at the blind side of the outside escutcheon 24. A laterally projecting tab 100 on the case 97 is received into a side slot 102 in the receptacle member 98 to prevent lock cylinder rotation therein. A key port 104 is exposed through the outside escutcheon (FIG. 2) and is adapted to receive the conventional key 36 for rotating a blade-shaped tailpiece 106 (FIG. 3). The tailpiece 106 projects in a conventional manner through a slotted keyway 108 in the lock mechanism 32 for key-operated movement of the latch 38 between locked and unlocked positions. The blind end of the tailpiece 106 protrudes through and beyond the lock mechanism 32 for reception into a slotted passage 110 formed in a drive adapter 112 mounted on the inside bracket plate 76. As viewed in FIGS. 3 and 12, this drive adapter 112 includes a stepped cylindrical base 112' for snap-fit mounting into an aperture 114 formed in the bracket plate 76. The stepped base 112' is formed integrally with a square cross-section drive member 116 having the slotted passage 110 formed therein. Accordingly, keyed rotation of the lock tailpiece 106 correspondingly rotates the square drive member 116, and vice versa.

In accordance with further aspects of the invention, the lock mechanism 32 can be operated to lock and unlock the associated door 12 with only the outside escutcheon 24 and the inside bracket plate 76 mounted on the door. This geometry, which may be particularly desirable during a construction phase, requires a contractor's key 117 (FIG. 3) or other suitable square socketed tool to rotate the drive member 116 for purposes of operating the lock mechanism 32, while permitting the inside escutcheon 28 and associated indoor handle 30 to be stored safe from construction damage and dirt.

As shown in FIGS. 3 and 13–18, the inside escutcheon 28 similarly includes a contoured exterior surface 118 of ornamental geometry which may be plated with a desired surface finish, and is adapted to mount over and conceal the bracket plate 76 at the indoor side of the door 12. The escutcheon 28 defines a pair of laterally open slots 120 for removable mounting of the indoor handle 30. In this regard, the indoor handle similarly includes a shaped grip bar 122 having cylindrical cuffs 124 near its opposite ends for seated reception into cylindrical support rings 126 of a pair of handle support arms 128. The grip bar cuffs 124 including outwardly projecting keys 130 for seating into aligned key slots 132 within the support rings 126. Base ends of the support arms 128 fit closely through the escutcheon slots 120, with semicylindrical recesses 134 aligning with similar semicylindrical recesses 136 at the blind side of the inside escutcheon 28 to receive mounting screws 138 such as self-threading screws. When the support arms 128 are secured to the escutcheon 28, side faces 140 of the support arms are disposed substantially flush with a corresponding side face of the inside escutcheon 28.

The inside escutcheon 28 and related handle geometry as described above permits the indoor handle 30 to be reversibly mounted onto the inside escutcheon 28, in generally the same manner as described previously with respect to the outside escutcheon 24. That is, the inside handle 30 is normally positioned along one side of the escutcheon 28 opposite the adjacent door jamb, with the alternative handle mounting geometries being depicted respectively in FIGS. 1 and 24. Importantly, the assembled handle components provide a stable and rigid handle construction when connected in the desired orientation onto the inside escutcheon 28.

The latch lever 18 is installed on the inside escutcheon 28 for selectively operating the drive member 116 on the bracket plate 76 (FIG. 3), to correspondingly operate the lock mechanism 32. In this regard, as shown best in FIG. 19, the latch lever comprises a base 142 having a square passage 144 formed therein and an elongated operating lever 146 projecting outwardly therefrom. A lever cap 148 has a square driver 150 for close-fit reception through the passage 144. The square driver 150 seats into one end of a square socket 152 in a drive head 154 mounted rotatably within the inside escutcheon 28 by means of a cylindrical bushing sleeve 156 or the like. A threaded fastener 158 is fitted through the drive head 154 from the blind side thereof for connection into a threaded bore 160 in the cap driver 150, wherein this threaded bore 160 may also be laterally vented for improved plating fluid drainage. Alternately, while squared drive connections are preferred, it will be understood that the other noncircular geometries may be used.

An inboard end of the drive head socket 152 fits closely over the drive member 116 of the drive adapter 112 when the inside escutcheon 28 is mounted onto the bracket plate 76 by means of mounting screws 162 or the like. Such mounting screws 162 are passed through a pair of openings 163 at the upper and lower ends of the inside escutcheon 28 for threaded attachment into a pair of threaded mounting sleeves 94 on the inside bracket plate 76 (FIG. 3). With this configuration, rotation of the latch lever 18 correspondingly rotates the drive head 154 on the inside escutcheon 28 and the drive adapter 112 to operate the lock mechanism 32. A cam segment 164 at the inboard end of the drive head 154 includes outwardly presented cam lobes for engagement by an opposed pair of set pins 166 biased by an associated pair of biasing springs 168. These set pins 166 (FIGS. 17 and 19) are seated within shallow pockets 167 formed at the blind side of the escutcheon 28 and permit drive head rotation reversibly through an angular increment of about 90., and are appropriately contoured to urge the drive head toward either end of its rotational swing to positively place the latch lever in the locked or unlocked position. In this regard, FIG. 1 illustrates the latch lever in a locked position to extend downwardly in generally parallel alignment with the inside escutcheon 28, and in the unlocked position (dotted lines) providing a large and highly visible flag projecting perpendicularly to the escutcheon 28.

The latch lever 18 is quickly and easily reversed with respect to the inside escutcheon 28, in accordance with the position of mounting the lock assembly onto the door 12. That is, the lever 18 is removable from the inside escutcheon 28 by retracting the associated screw 158 sufficiently to separate the latch lever 18 and associated cap 148 from the drive head 154. The lever 18 can then be positionally reversed relative to the drive head, as viewed in FIGS. 20, 21 and 24, and then rotated 90° for reinstallation with the cap 148 onto inside escutcheon 28. With such reconfiguration, the latch lever 18 is properly oriented for alternative mounting of the inside escutcheon 28 onto the opposite stile of an associated door 12.

Accordingly, the improved door handle and lock assembly 10 of the present invention provides a highly versatile combination of components adapted for assembly in the appropriate configuration for mounting onto the door stile at either side edge of a sliding door. The assembly includes multipart handles which can be subjected to high quality plating finish operations, and then assembled to provide a secure and rigid handle construction in one of two different door configurations. Moreover, the invention accommodates use of a relatively large latch lever at the indoor side of the door, wherein this latch lever is easily operated and provides a highly visible flag indicating the locked or unlocked state of the door hardware.

A variety of further modifications and improvements to the improved door handle and lock assembly of the present invention will be apparent to those skilled in the art. Accordingly, no limitation on the invention is intended by way of the foregoing description and accompanying drawings, except as set forth in the appended claims.

What is claimed is:

1. A door handle and lock assembly for mounting onto the stile of a sliding door, said assembly comprising:

an outside escutcheon;

an outdoor handle reversibly mounted in one of two different positions on said outside escutcheon;

an inside bracket plate;

a lock mechanism adapted for mounting onto the door stile:

means for interconnecting said bracket plate and said outside escutcheon in fixed position on opposite sides of the door stile;

operator means carried by said bracket plate for operating said lock mechanism to selectively lock and unlock the door;

an inside escutcheon;

means for mounting said inside escutcheon on said bracket plate, said inside escutcheon including latch means engageable with said operator means for operating said lock mechanism; and an indoor handle reversibly mounted in one of two different positions on said inside escutcheon.

2. The door handle and lock assembly of claim 1 wherein said latch means comprises an elongated latch lever, and means for reversibly mounting said latch lever onto said inside escutcheon in operative association with said operator means on said bracket plate, when said inside escutcheon is mounted on said bracket plate.

3. The door handle and lock assembly of claim 1 further including a keyed lock unit carried by said outside escutcheon in operative association with said lock mechanism.

4. The door handle and lock assembly of claim 3 wherein said lock mechanism includes a latch movable between extended and retracted positions for respectively locking and unlocking the door, and a driven member rotatably connected with said keyed lock unit and said operator means for displacing said latch between the extended and retracted positions.

5. The door handle and lock assembly of claim 1 further including key means engageable with said operator means on said bracket plate for operating said lock mechanism prior to mounting of said inside escutcheon onto said bracket plate.

6. The door handle and lock assembly of claim 1 wherein said bracket plate has a plurality of laterally elongated holes formed therein, and further wherein said outside escutcheon has a blind side defining a plurality of threaded mounting sleeves arranged in laterally adjacent pairs in general alignment with said laterally elongated holes in said bracket plate, said interconnecting means comprising a plurality of mounting screws extending through selected ones of said bracket plate holes and through the stile for threaded reception into aligned ones of said mounting sleeves at the blind side of said outside escutcheon.

7. The door handle and locking assembly of claim 6 wherein at least some of said mounting sleeves have a part-cylindrical vented configuration.

8. The door handle and lock assembly of claim 7 further including at least one fillet web associated with each of the vented mounting sleeves.

9. The door handle and lock assembly of claim 8 wherein each of said fillet webs is disposed adjacent an open margin of the associated vented mounting sleeve.

10. The door handle and lock assembly of claim 6 wherein said bracket plate further defines an auxiliary mounting hole near one end thereof, and further wherein said outside escutcheon includes an auxiliary mounting sleeve in general alignment with said auxiliary mounting hole when said bracket plate and said outside escutcheon are interconnected, and further including a drill guide defining alignment means engageable with said bracket plate to orient said drill guide on the bracket plate in a predetermined position, said drill guide further defining a guide sleeve aligned with said auxiliary mounting hole when said drill guide is in said predetermined position, said guide sleeve being adapted for passage of a drill bit to form an auxiliary opening in the stile to receive an auxiliary mounting screw fastened through said bracket plate auxiliary hole and into said outside escutcheon auxiliary mounting sleeve.

11. The door handle and lock assembly of claim 1 wherein said outside escutcheon has at least one laterally open slot formed therein, said outdoor handle comprising a support arm having a base end reversibly receivable into said escutcheon slot and an outboard end supporting a handle grip bar, and further including means for securing said base end of said handle support arm to said outside escutcheon within said escutcheon slot.

12. The door handle and lock assembly of claim 11 wherein said support arm base end and said outside escutcheon define interlocking key and notch means for locating said support arm base end at a predetermined seated position within said escutcheon slot.

13. The door handle and lock assembly of claim 11 wherein said support arm base end and said outside escutcheon respectively include semicylindrical recesses which cooperatively define an open bore when said support arm base end is received into said escutcheon slot, said securing means comprising a fastener seated within said open bore.

14. The door handle and lock assembly of claim 13 wherein said fastener is a threaded fastener.

15. The door handle and lock assembly of claim 13 wherein said fastener is a self-threading screw.

16. The door handle and lock assembly of claim 11 wherein said outside escutcheon has a pair of laterally open slots formed therein, said outdoor handle comprising a pair of support arms having base ends respectively and reversibly receivable into said escutcheon slots and outboard ends having a handle grip bar supported therebetween, and further including means for securing said base ends of said handle support arms to said outside escutcheon.

17. The door handle and lock assembly of claim 16 wherein said support arms each include a side face disposed substantially flush with a side face of said outside escutcheon when said support arms are secured within said escutcheon slots.

18. The door handle and lock assembly of claim 16 wherein said support arm outboard ends each define a generally annular support ring, said grip bar defining an elongated handle member having generally cylindrical cuffs near the opposite ends thereof for seated reception into said support rings of said support arms.

19. The door handle and lock assembly of claim 18 wherein said support rings and said cuffs include interlocking key means to prevent rotation of said grip bar within said support rings.

20. The door handle and lock assembly of claim 18 wherein said cuffs further include plating rack dimples formed therein in positions for concealment within said support rings.

21. The door handle and lock assembly of claim 1 wherein said inside escutcheon has at least one laterally open slot formed therein, said indoor handle comprising a support arm having a base end reversibly receivable into said escutcheon slot and an outboard end supporting a handle grip bar, and further including means for securing said base end of said handle support arm to said inside escutcheon within said escutcheon slot.

22. The door handle and lock assembly of claim 21 wherein said support arm base end and said inside escutcheon define interlocking key and notch means for locating said support arm base end at a predetermined seated position within said escutcheon slot.

23. The door handle and lock assembly of claim 21 wherein said support arm base end and said inside escutcheon respectively include semicylindrical recesses which cooperatively define an open bore when said support arm base end is received into said escutcheon slot, said securing means comprising a fastener seated within said open bore.

24. The door handle and lock assembly of claim 23 wherein said fastener is a threaded fastener.

25. The door handle and lock assembly of claim 24 wherein said fastener is a self-threading screw.

26. The door handle and lock assembly of claim 21 wherein said inside escutcheon has a pair of laterally open slots formed therein, said indoor handle comprising a pair of support arms having base ends respectively and reversibly receivable into said escutcheon slots and outboard ends having a handle grip bar supported therebetween, and further including means for securing said base ends of said handle support arms to said inside escutcheon.

27. The door handle and lock assembly of claim 26 wherein said support arms each include a side face disposed substantially flush with a side face of said inside escutcheon when said support arms are secured within said escutcheon slots.

28. The door handle and lock assembly of claim 16 wherein said support arm outboard ends each define a generally annular support ring, said grip bar defining an elongated handle member having generally cylindrical cuffs near the opposite ends thereof for seated reception into said support rings of said support arms.

29. The door handle and lock assembly of claim 28 wherein said support rings and said cuffs include interlocking key means to prevent rotation of said grip bar within said support rings.

30. The door handle and lock assembly of claim 29 wherein said cuffs further include plating rack dimples formed therein in positions for concealment within said support rings.

31. The door handle and lock assembly of claim 1 wherein said operator means comprises a drive adapter rotatably supported on said bracket plate, said drive adapter defining a drive member of noncircular cross section engageable by a drive head rotatably mounted on said inside escutcheon and having a drive socket for mating reception of said drive member, said latch means including an elongated latch lever and means for reversibly mounting said latch lever to said drive head.

32. The door handle and lock assembly of claim 31 wherein said latch lever comprises a lever disk having an noncircular opening formed therein and an elongated lever member projecting outwardly therefrom, a cap adapted to overlie one side of said disk and including a noncircular driver shaped for mating reception through said disk opening in a selected one of at least two different positions, and fastener means for removably attaching said cap to said drive head, said cap being removable from said drive head and said disk to permit reversible mounting of said latch lever onto said drive head in a selected one of least two different rotational positions.

33. The door handle and lock assembly of claim 31 further including cam means on said drive head and the blind side of said inside escutcheon and engageable to restrict rotation of said drive head relative to said inside escutcheon to rotation back and forth within a limited arcuate range of motion.

34. A door escutcheon, comprising:

an escutcheon plate adapted for mounting onto a door and defining an outboard side and a blind side, said blind side including at least one threaded sleeve for receiving a threaded fastener, said at least one threaded sleeve having a part-cylindrical shape defining an open side vent, and further including at least one fillet web for structurally reinforcing said sleeve relative to said plate.

35. The door escutcheon of claim 34 wherein said at least one fillet web is disposed generally along one side margin of said vent.

36. The door escutcheon of claim 34 wherein said blind side includes a plurality of threaded sleeves each having a part-cylindrical shape defining an open side vent, said threaded sleeves being arranged in adjacent pairs.

37. A door handle and escutcheon assembly, comprising:

an escutcheon having at least one laterally open slot formed therein;

a handle including a support arm having a base end for reversible reception into said slot and an outboard end supporting a handle grip bar; and means for securing said support arm within said slot, said securing means comprising semicylindrical recesses formed respectively in said support arm base end and in said escutcheon, said recesses cooperatively defining an open bore when said bore end is received into said slot, and a fastener receivable into said open bore to secure said support arm to said escutcheon.

38. The door handle and escutcheon assembly of claim 37 wherein said fastener is a threaded fastener.

39. The door handle and escutcheon assembly of claim 27 wherein said escutcheon has a pair of laterally open slots formed therein, said handle including a pair of support arms having base ends respectively and reversibly receivable into said escutcheon slots and outboard ends having a handle grip bar supported therebetween, and further including means for securing said base ends of said handle support arms to said escutcheon.

40. The door handle and escutcheon assembly of claim 39 wherein said support arms each include a side face disposed substantially flush with a side face of said escutcheon when said support arms are secured within said escutcheon slots.

41. The door handle and escutcheon assembly of claim 39 wherein said support arm outboard ends each define a generally annular support ring, said grip bar defining an elongated handle member having generally cylindrical cuffs near the opposite ends thereof for seated reception into said support rings of said support arms.

42. The door handle and escutcheon assembly of claim 41 wherein said support rings and said cuffs include interlocking key means to prevent rotation of said grip bar within said support rings.

43. The door handle and escutcheon assembly of claim 41 wherein said cuffs further include plating rack dimples formed therein in positions for concealment within said support rings.

* * * * *